US005781997A

United States Patent [19]

Ferraro et al.

[11] Patent Number: 5,781,997

[45] Date of Patent: Jul. 21, 1998

[54] ULTRA-FLEXIBLE SHAVING CARTRIDGE

[75] Inventors: Frank Anthony Ferraro, Trumbull, Conn.; Ernest Albert Ortiz, Chapel Hill, N.C.

[73] Assignee: Warner-Lambert Company, Morris Plains, N.J.

[21] Appl. No.: 785,706

[22] Filed: Jan. 17, 1997

[51] Int. Cl.[6] ..... B26B 21/02

[52] U.S. Cl. ..... 30/50; 30/47

[58] Field of Search ..... 30/41, 47, 50

[56] References Cited

U.S. PATENT DOCUMENTS

| | | | |
|---|---|---|---|
| 4,069,580 | 1/1978 | Cartwright et al. | 30/47 |
| 4,200,976 | 5/1980 | Gooding | 30/47 |
| 4,516,320 | 5/1985 | Peleckis | 30/50 |
| 4,624,051 | 11/1986 | Aprille, Jr. et al. | 30/50 |
| 4,641,429 | 2/1987 | Abatemarco | 30/41 |
| 4,854,043 | 8/1989 | Chen | 30/50 |
| 5,095,619 | 3/1992 | Davis et al. | 30/41 |

*Primary Examiner*—Hwei-Siu Payer
*Attorney, Agent, or Firm*—Charles W. Almer

[57] ABSTRACT

A flexible razor head which can flex convexly and concavely during shaving to follow the contours of a skin surface. A blade support comprises a rubber-like material which is compressible and preferably allows the blades to angularly and vertically deflect.

23 Claims, 7 Drawing Sheets

ULTRA-FLEXIBLE SHAVING CARTRIDGE

The present invention is directed to flexible razor heads, and more particularly, to ultra-flexible razor heads which can flex convexly and concavely throughout the shaving process to follow the contours of a skin surface.

BACKGROUND OF THE INVENTION

Shaving systems such as safety razors have found widespread use for providing close and comfortable shaves. Safety razors traditionally included one or two blades disposed between a rigid guard and a rigid cap. Each of these elements was typically rigidly fixed relative to one another and disposed in skin-engaging contact during shaving. However, various skin contours and crevices tended to create an imbalance of shaving forces with the straightness of such rigid blade constructions increasing the risk of nicks and cuts.

Shaving systems have been disclosed which utilize flexible blades which generally flex downwardly into a concave configuration in order to follow the contour of a protruding skin area. However, it has not previously been suggested to position a razor head in a convex configuration in order to shave concave skin surfaces, such as underarms, and recessed areas of the face and neck.

It would, therefore, be desirable to provide a shaving system whereby a blade can conform more closely to both concave and convex contours of a skin surface during shaving. In addition, it would be desirable to provide a shaving system whereby a plurality of blades can conform to concave and convex contours of a skin surface, and can vertically and angularly adjust with respect to each other and the skin surface. Such systems would reduce the likelihood of nicks and cuts, as well as more evenly distribute the cutting forces across the length of the blade edge so that each stroke is more efficient.

SUMMARY OF THE INVENTION

Various embodiments of the present invention are directed to razor heads which comprise at least one blade, and a support comprising a cap, a seat, and side walls, wherein the support comprises a resilient material, e.g. a thermoplastic elastomer, for partially encapsulating and flexibly supporting at least one blade.

Other embodiments of the present invention are directed to razor heads having at least one blade, and a support comprising a flexible lower portion which comprises a generally planar rear portion having alternating cutouts, and a projecting segmented front portion.

These and other embodiments of the present invention are described below with reference to the drawings.

DETAILED DESCRIPTION

Various embodiments of the present invention are directed to razor heads which are flexible concavely and convexly, e.g., in both an upwardly and a downwardly direction, to conform to curved surfaces during shaving. In preferred embodiments, the blade or blades are vertically and angularly adjustable to the skin surface.

Figure 1:
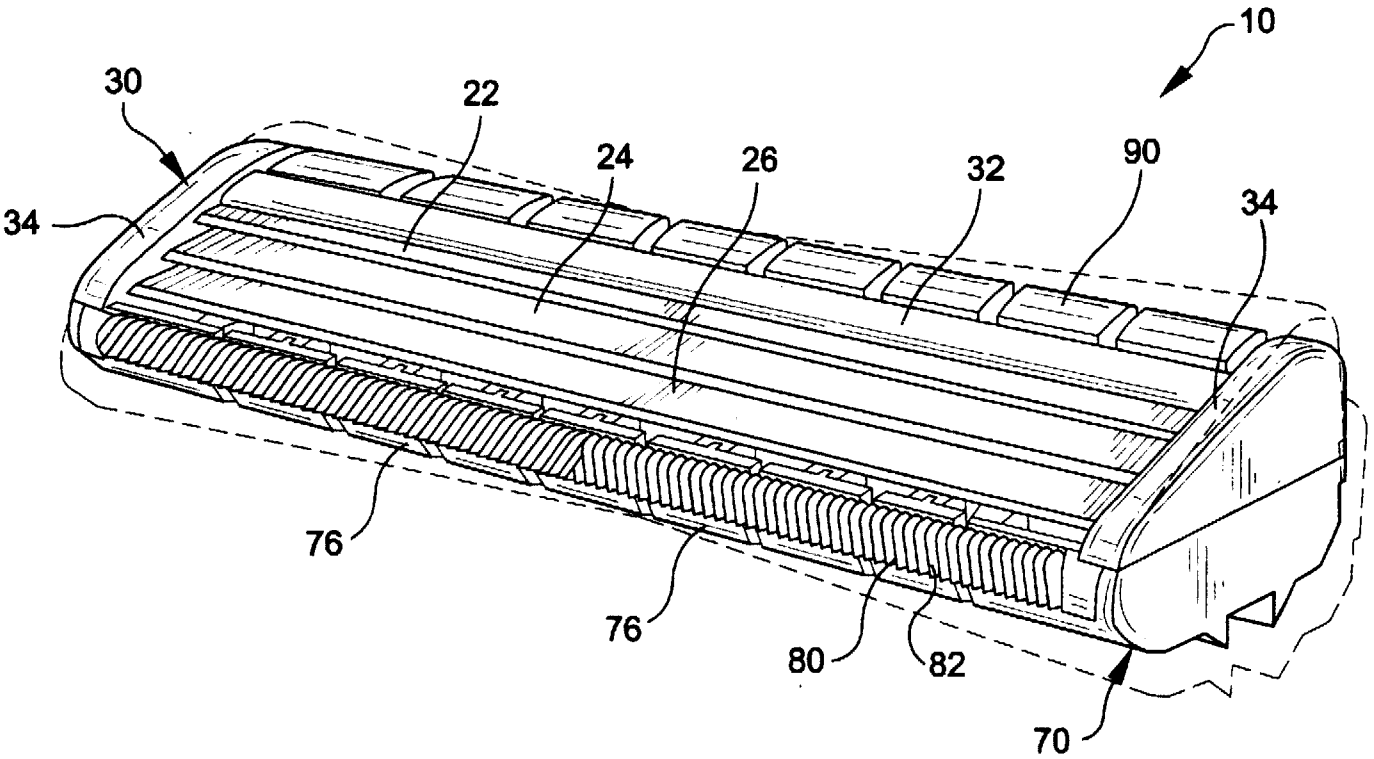
FIG. 1 is a perspective view of one embodiment of a razor head of the present invention.
Figure 2:
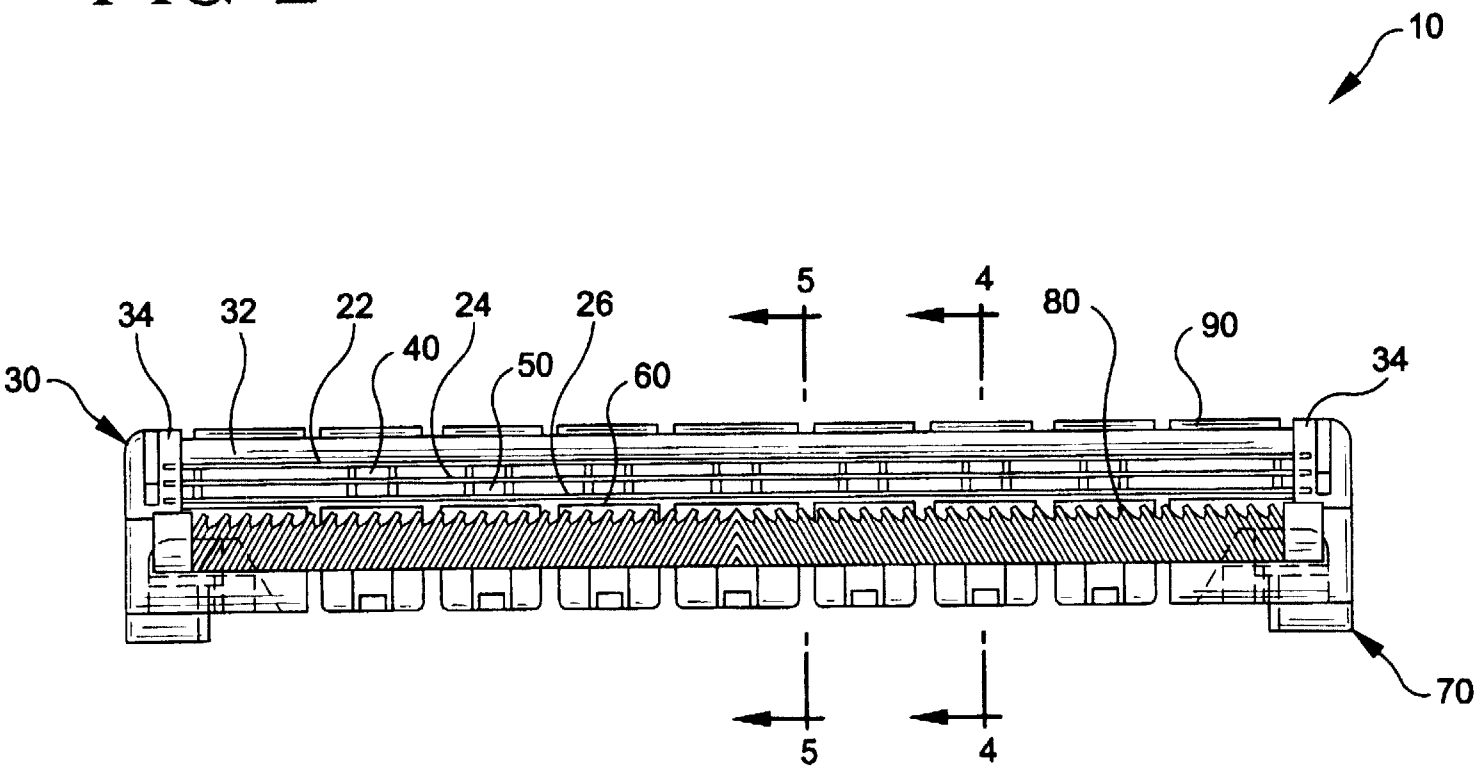
FIG. 2 is a front view of the razor head shown in FIG. 1.
Figure 3:
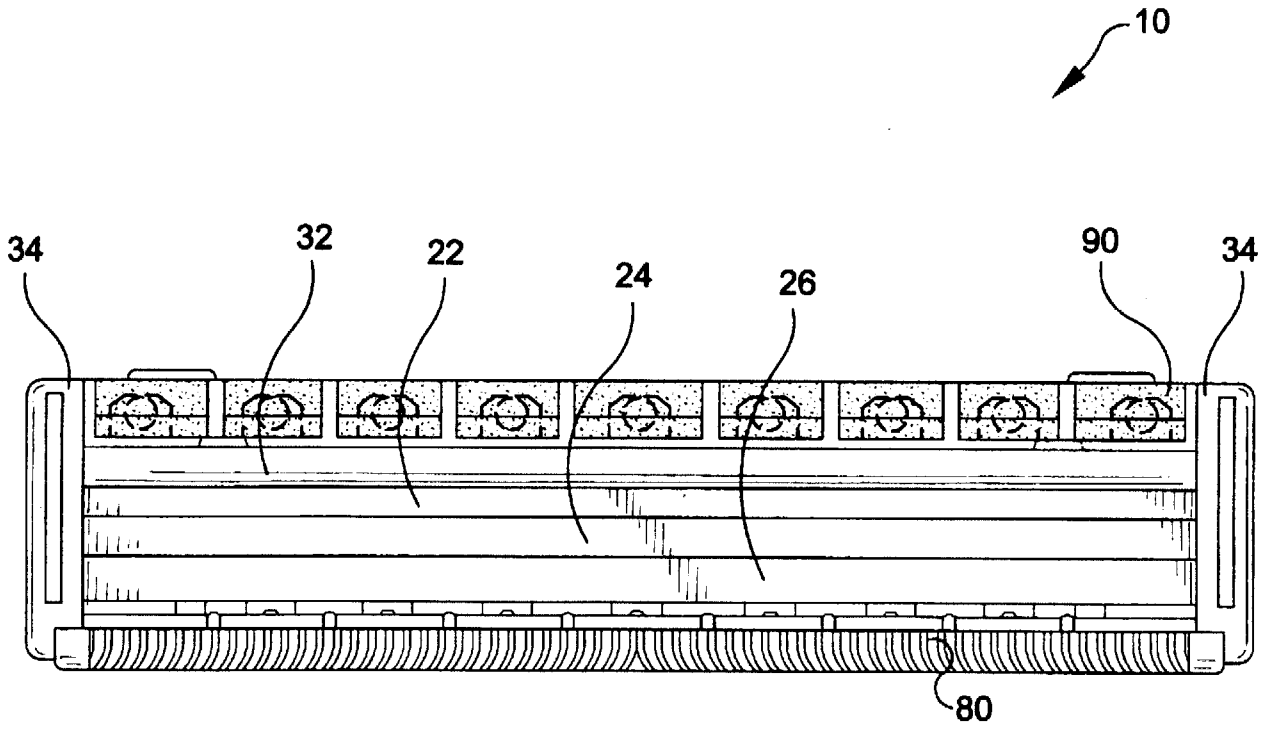
FIG. 3 is a top view of the razor head shown in FIG. 1.

One illustrated embodiment of the present invention is shown in FIGS. 1 and 2, and comprises an ultra-flexible razor head 10 generally comprising a flexible upper support portion 30 which supports three flexible blades such as a cap or trailing blade 22, a middle blade 24, and a seat or leading blade 26. In this illustrated embodiment, flexible upper support portion 30 is connected to a flexible lower support portion 70 which is securely and releasably attachable to a razor (not shown). FIG. 1 illustrates, in dashed lines, razor head 10 in concave and convex configurations.

As used herein, the term "razor head" is meant to include cartridges adapted to be connected to a separate razor as well as the operative cutting portion of a disposable razor wherein the handle and cutting portion are formed as a unit. The term "flexible" is used to indicate a bending capability of a blade along the blade's longitudinal axis in response to shaving forces. The term "ultra-flexible" is meant to indicate a bending capability of a blade along the blade's longitudinal axis as well as the capability of the blade(s) to vertically and angularly deflect. The term "rubber-like" includes both natural and synthetic elastic substances such as thermoplastic elastomers. The rubber-like materials of the present invention preferably have a hardness value of about 30 to about 80 Shore A, preferably about 35 to about 45 Shore A and most preferably a hardness value of about 40 Shore A.

Figure 4:
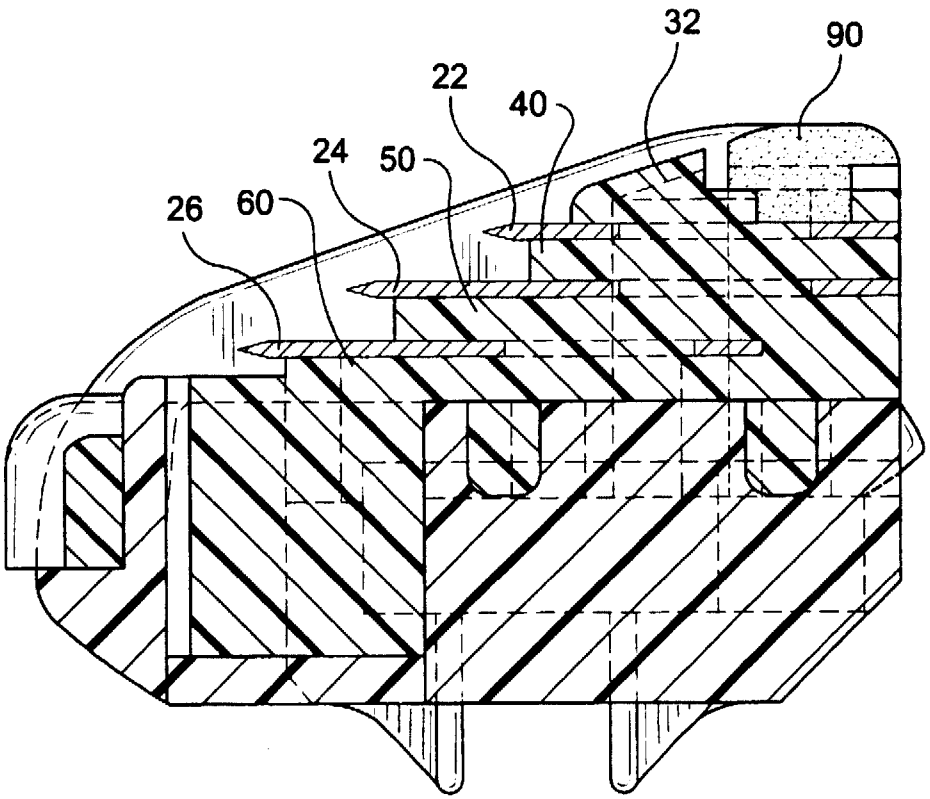
FIG. 4 is an enlarged cross-sectional view taken along line 4—4 in FIG. 2.
Figure 5:
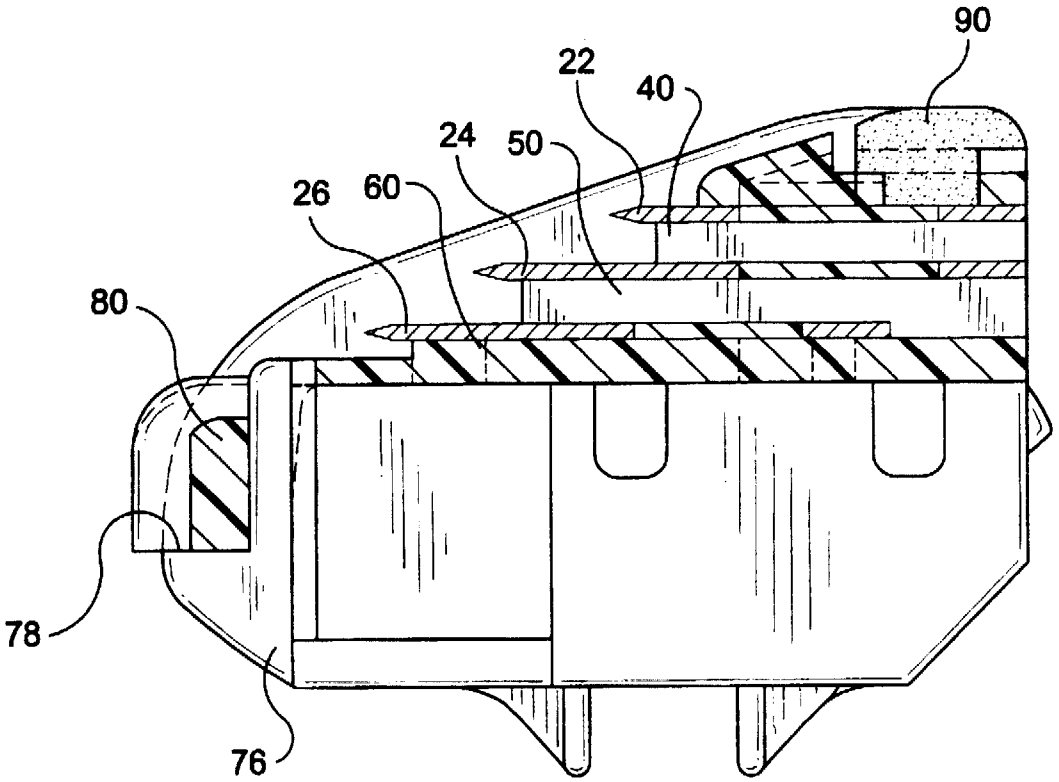
FIG. 5 is an enlarged cross-sectional view taken along line 5—5 in FIG. 2.

In the illustrated embodiment shown in FIGS. 1 and 2, flexible upper support portion 30 comprises a rubber-like cap 32 attached to cap blade 22, opposite rubber-like sides 34 into which extend the end portions of the blades, and a plurality of rubber spacers for supporting blades 22, 24 and 26 in spaced-apart relation. As best shown in FIGS. 2, 4 and 5, a plurality of rubber-like spacers 40 are disposed between cap blade 22 and middle blade 24, and a plurality of rubber-like spacers 50 are disposed between middle blade 24 and seat blade 26. A rubber-like spacer 60 extends along and is attached to the bottom of seat blade 26.

As illustrated, the upper portion of razor head 10 partially encases the blades to resiliently and flexibly support the blades in a generally vertically spaced-apart relation, as well as in a generally horizontally spaced-apart relation across the width of the support. In addition to resiliently and flexibly supporting the blades, the use of a rubber-like material for the cap and side walls preferably provides relatively high friction skin-engaging surfaces. Such materials tend to stretch the skin during shaving to enhance the control of the razor head on a skin surface providing closer shaves than conventional, rigid polymeric material which can slide across the skin during shaving.

Preferably, flexible upper support portion is fabricated from a rubber-like material having a hardness value of about 30 to about 80 Shore A, preferably about 35 to about 45 Shore A and most preferably a hardness value of about 40 Shore A.

Figure 7:
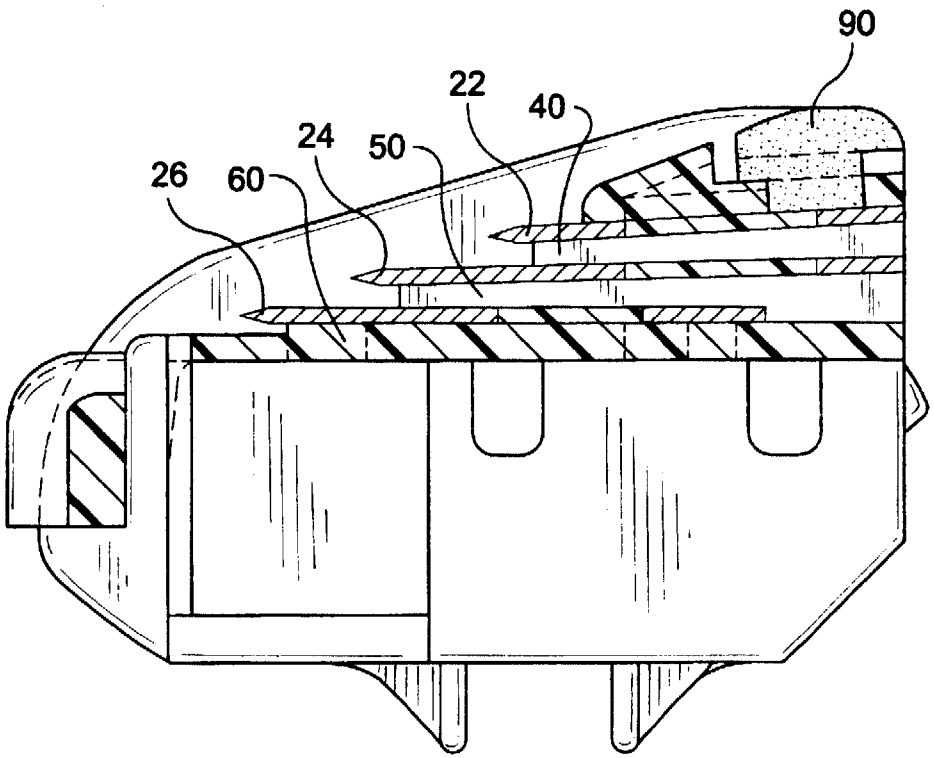
FIG. 7 is an enlarged cross-sectional view of the razor head of FIG. 5 in which the blades of the razor head are undergoing vertical and angular deflection.

From the present description, it will be appreciated to those skilled in the art that fabricating the flexible upper support portion from a rubber-like material permits the blades to execute multiple degrees of dynamic movement during shaving. Specifically, as illustrated in FIG. 7, in addition to allowing the blades to flex concavely and convexly along their length, the rubber-like material acts as a cushion, e.g., compresses, allowing the blades 22, 24 and 26 to deflect, downwardly and/or angularly, when subjected to shaving forces, so that the blades are self-adjusting to equalize the forces between the skin and the cushioned blades. This equalization is designed to provide the correct interaction between skin and cutting edges resulting in a smooth, comfortable, and close shave.

Figure 6:
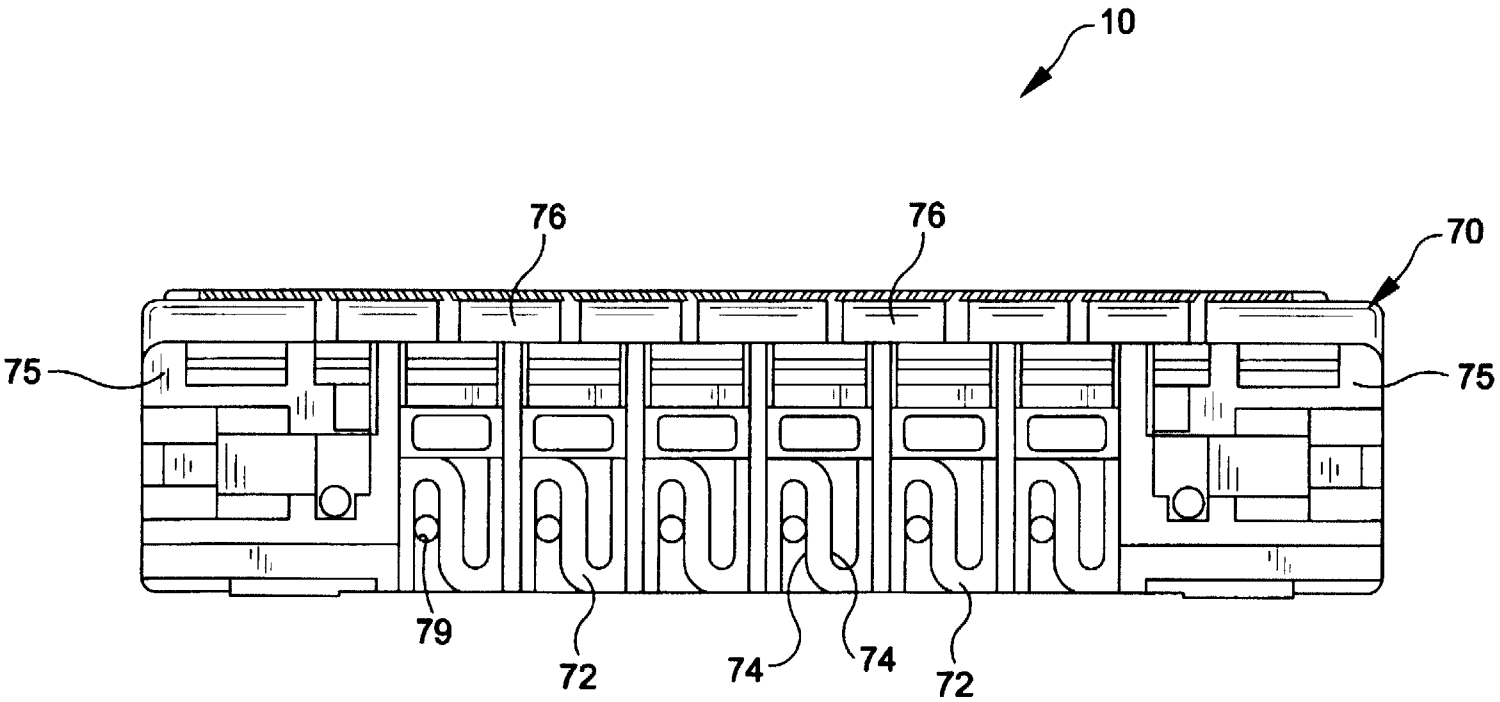
FIG. 6 is a bottom view of the razor head shown in FIG. 1.

As shown in FIG. 1, flexible lower support 70 is structured to flexibly support upper support portion 30 and also attach securely to a razor (not shown). As best shown in FIG. 6, in this illustrated embodiment, lower support portion 70 comprises a generally planar rear portion 72 having alternating cutouts 74, leaving a generally sinusoidal support adapted for flexing either concavely or convexly in response to forces encountered during shaving. The illustrated rear portion 72 is different from previously disclosed flexible razor heads which had generally planar blade seat segments connected by downwardly-extending, corrugated connecting members. Rear portion 72 of flexible lower portion 70 requires less material compared to conventional corrugated seats making it easier to flex.

Lower support 70 also comprises a plurality of segmented front portions 76 comprising generally T-shaped segments which extend from and are cantilevered from the bottom surface of rear portion 72 and which are independently flexible to form a flexible segmented guard. Rear portion 72 and segmented front portions 76 are designed to permit lower flexible support portion 70 to flex and lengthen in response to shaving forces.

While the bottom view of FIG. 6 shows the generally sinusoidal, convoluted rear portion 72 as being visible from the bottom, it is also within the scope of the present invention to encapsulate the convolusions of the rear portion 72 with the resilient material used in forming flexible upper portion 30. Preferably, rubber-like spacer 60 extends into alternating cutouts 74 in rear portion 72. In addition, the blades can be provided with holes 79 through which blade support pins can be inserted.

Front portions 76, as shown in FIG. 5, comprise a shelf 78 for supporting a resilient guard portion 80. As shown in FIG. 1, guard portion 80 extends most of the length of support 30 and is attached to segmented front portions 76. Preferably, guard portion 80 comprises a plurality of generally angular extending grooves 82. Desirably, the grooves are angled at about 30 degrees and are disposed in one direction on one side of the guard and disposed in an opposite direction on the other side of the guard. Providing such a groove allows a greater portion of shaving lubricant to remain on the skin surface than a horizontally grooved guard. Preferably, guard portion 80 is formed from the resilient material used in forming flexible upper support portion 30.

From the present description, it will be appreciated to those skilled in the art that the segmented portions which form a segmented guard is constructed such that it also executes a degree of dynamic action that interacts with the cushioned blade to optimize the geometry, e.g., conform to the skin surface by readily convexly and concavely flexing, to achieve close, comfortable shaves.

As shown in FIG. 6, flexible lower support portion 70 is provided with mounts 75 for releasably attaching to a razor (not shown). Desirably, razor head 10 is releasably attachable to a razor capable of actively flexing razor head 10, i.e., attachable to a razor which in response to shaving forces directed on a portion of razor head 10 in one direction, e.g., downwardly, causes a different portion of razor head 10 to move in an opposite direction, e.g., upwardly. Such a razor is disclosed in U.S. patent application Ser. No. 08/785,475, entitled RAZORS WHICH ACTIVELY FLEX A RAZOR HEAD IN RESPONSE TO SHAVING FORCES, filed concurrently herewith which is incorporated by reference.

While the illustrated embodiment is shown comprising a solid rubber-like cap, solid rubber-like sides, and solid rubber-like spacers, from the present description it will be appreciated to those skilled in the art that it may be suitable to provide a cap, sides, and/or spacers which are hollow, or suitable to provide a cap, sides and spacers only having a layer of rubber-like material on the outside thereof. Preferably, cap 32, opposite sides 34 and spacers 36 are fabricated from suitable resilient rubber-like materials, for example, Dynaflex GS6740 or GLS-G2712-45A manufactured by GLS Corporation of Cary, Ill., J-Von-Hercuprene 3000-45A manufactured by J-Von LP, Leominster, Mass., and other suitable thermoplastic elastomers.

Preferably, flexible lower support portion 80 is fabricated from suitable materials having a hardness greater than upper support portion 30, for example, polypropylene, polyethylene, styrenes, ABS (acrylonitrile-butadine-styrene), or combinations thereof. Desirably, the materials for the cap, spacers, sides, and seat are chosen and configured so that when such shaving forces are removed, the inherent resiliency of the support and the blades are preferably sufficient to return the support and the blades to an original position.

Although the upper and lower portions of the housing are illustrated as being integrally formed, they could also be formed as separate elements and subsequently assembled. From the present description, it will be appreciated by those skilled in the art that the support can be formed by a combination of insert molding and/or sequentially molded steps. In addition, it will be appreciated that the blades can be provided with one or more holes for providing a more positive attachment to the cap, spacers, and resilient seat layer.

As shown in FIG. 2, the configuration of razor head 10 with a plurality of spacers 40 and 50 provide improved rinseability for rinsing shaving debris from the spaces between the blades compared to a single solid spacer disposed between adjacent blades.

In addition, the illustrated embodiment which provides three blades increases the total area of the cutting edge of the razor head by fifty percent over the embodiment with two blades to improve shave closeness and efficiency.

Another preferred embodiment of the present invention comprises a razor head, as described above, in which razor head 10 further comprises a skin-engaging shaving aid material. Preferably, a shaving aid material 90 is formed in a plurality of segments which are attached to recessed portions of cap 32.

A number of different materials have been suggested for use as shaving aids. The term "shaving aid," as used herein, refers equally either to the active ingredient combined within a delivery system, such as a water-insoluble microporous matrix structure or to the active ingredient alone. Previously suggested active ingredients include those disclosed in U.S. Pat. No. 4,170,821 to Booth, which is hereby incorporated by reference. A shaving aid may comprise one or various combinations of the following:

A. A lubricating agent for reducing the frictional forces between the razor and the skin, e.g., a micro-encapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccharide derived from plant materials such as "guar gum."

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium lauryl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

H. An astringent for constricting blood vessels thereby stemming the flow of bodily fluids such as lymph, which may exude from skin which has been irritated during shaving.

Alternatively, the shaving aid may comprise one or more of the shaving aids disclosed in U.S. Pat. No. 5,056,221 to Thoene, U.S. Pat. No. 4,044,120 to Rowsell et al., U.S. Pat. No. 5,095,619 to Davis et al., or Japanese Patent Application No. Hei 7 [1995]- 24156 to Miyazaki, et al. which are also hereby incorporated by reference.

Other active ingredients may include various pigments, e.g., titanium dioxide, fragrances, aloe vera, flavoring agents, mineral oils, essential oils and other oils derived from plants. In addition to one or more active ingredients, the shaving aids of the present invention may also comprise other compounds or blends of compounds such as water-insoluble polymers such as polystyrene and polypropylene.

What is claimed is:

1. A razor head flexible convexly and concavely in response to shaving forces comprising:

at least one flexible blade; and a resilient blade support which supports said blade, wherein said resilient blade support comprises a flexible material which is compressible in response to shaving forces exerted on said blade and said support comprises a lower support portion comprising generally sinusoidal configurations and said sinusoidal configurations are generally in a plane which is substantially parallel to a plane of said at least one blade when said razor head is not flexed.

2. A razor head according to claim 1 wherein said flexible material has a hardness value of about 30 to about 80 Shore A.

3. A razor head according to claim 2 wherein said flexible material has a hardness value between about 35 to 45 Shore A.

4. A razor head according to claim 3 wherein said flexible material has a hardness value of about 40 Shore A.

5. A razor head according to claim 1 wherein said blade support allows said blade to deflect downwardly.

6. A razor head according to claim 1 wherein said blade support allows said blade to deflect angularly.

7. A razor head according to claim 1 wherein said support comprises an upper support portion comprising flexible material for supporting said blade and said lower support portion comprising a material different from said upper support portion.

8. A razor head according to claim 7 wherein said upper support is formed entirely of flexible material.

9. A razor head according to claim 7 wherein said lower support portion is formed from a material having a greater hardness than said upper support portion.

10. A razor head according to claim 7 wherein said upper support portion and said lower support portion are integrally formed.

11. A razor head according to claim 1 wherein said at least one flexible blade comprises a plurality of flexible blades.

12. A razor head according to claim 11 wherein said support comprises a plurality of spacers disposed between at least two of said blades.

13. A razor head according to claim 1 wherein said at least one flexible blade comprises a cap blade, a middle blade, and a seat blade.

14. A razor heed according to claim 13 wherein said support comprises a plurality of spacers disposed between said cap blade and said middle blade, and between said middle blade and said seat blade.

15. A razor head according to claim 14 wherein said spacers are formed of a compressible flexible material.

16. A razor head according to claim 1 wherein said flexible material is a thermoplastic elastomer.

17. A razor head according to claim 1 wherein said support comprises a cap and sides with skin-engaging surfaces comprising a thermoplastic elastomer.

18. A razor head according to claim 1 wherein said lower support portion comprises a flexible material disposed between said sinusoidal configurations which are formed of a non-flexible material.

19. A razor head according to claim 1 wherein said lower support portion comprises a segmented guard bar.

20. A razor head according to claim 19 comprising a resilient skin-engaging element disposed forwardly of said guard bar.

21. A razor head according to claim 1 further comprising a shaving aid.

22. A razor head according to claim 21 wherein said shaving aid comprises at least one material selected from the group consisting of a lubricating agent, a medicinal agent, a vitamin, a cosmetic agent, a coagulant, an astringent, a cleaning agent, a skin conditioner, and blends thereof.

23. A razor head according to claim 21 wherein said shaving aid comprises a plurality of shaving aid segments.

* * * * *